US009347244B2

(12) United States Patent
Lu

(10) Patent No.: US 9,347,244 B2
(45) Date of Patent: May 24, 2016

(54) ELECTRONIC DEVICE

(71) Applicant: HON HAI PRECISION INDUSTRY CO., LTD., New Taipei (TW)

(72) Inventor: Pen-Uei Lu, New Taipei (TW)

(73) Assignee: HON HAI PRECISION INDUSTRY CO., LTD., New Taipei (TW)

( * ) Notice: Subject to any disclaimer, the term of this patent is extended or adjusted under 35 U.S.C. 154(b) by 0 days.

(21) Appl. No.: 14/614,801

(22) Filed: Feb. 5, 2015

(65) Prior Publication Data

US 2015/0282338 A1 Oct. 1, 2015

(30) Foreign Application Priority Data

Mar. 26, 2014 (TW) ..... 103111155 A

(51) Int. Cl.

| | |
|---|---|
| ***E05B 47/00*** | (2006.01) |
| ***G07C 9/00*** | (2006.01) |
| ***E05B 19/00*** | (2006.01) |
| *H01H 13/06* | (2006.01) |

(52) U.S. Cl.

CPC ..... *E05B 47/0001* (2013.01); *E05B 19/00* (2013.01); *E05B 2047/0088* (2013.01); *G07C 2009/00984* (2013.01); *H01H 13/06* (2013.01); *H01H 2223/003* (2013.01)

(58) Field of Classification Search

CPC ..... E05B 47/0001; E05B 19/00; E05B 2047/0088; G07C 2009/00984; G07C 2009/00222; G07C 2009/00952; H01H 2223/003; H01H 13/06

USPC ..... 361/752

See application file for complete search history.

(56) References Cited

U.S. PATENT DOCUMENTS

| | | | | |
|---|---|---|---|---|
| 7,041,924 | B2 * | 5/2006 | Jeschke | G07C 9/00944 200/302.2 |
| 2002/0008610 | A1 * | 1/2002 | Peterson | H01H 9/0214 340/5.64 |
| 2004/0085251 | A1 * | 5/2004 | Shimura | H04B 1/3888 343/872 |
| 2006/0023442 | A1 * | 2/2006 | De Los Santos | B60R 25/24 361/814 |
| 2007/0227866 | A1 * | 10/2007 | Dimig | E05B 19/0082 200/302.2 |
| 2008/0129448 | A1 * | 6/2008 | Reichling | G08C 17/02 340/5.72 |
| 2010/0108483 | A1 * | 5/2010 | Zuo | H01H 15/10 200/332.1 |
| 2010/0199729 | A1 * | 8/2010 | Zaitz | E05B 19/0082 70/237 |
| 2010/0206704 | A1 * | 8/2010 | Shimura | H01H 13/06 200/302.2 |
| 2010/0220451 | A1 * | 9/2010 | Zaitz | G07C 9/00944 361/752 |
| 2011/0241830 | A1 * | 10/2011 | Saito | G07C 9/00944 340/5.61 |
| 2012/0039052 | A1 * | 2/2012 | Valles Rangel | G07C 9/00944 361/752 |
| 2012/0186959 | A1 * | 7/2012 | Chen | H04M 1/236 200/329 |
| 2013/0044446 | A1 * | 2/2013 | Montarou | E05B 19/043 361/752 |
| 2014/0092535 | A1 * | 4/2014 | Chou | H05K 5/0217 361/679.01 |

* cited by examiner

*Primary Examiner* — Adrian S Wilson
*Assistant Examiner* — Abhishek Rathod
(74) *Attorney, Agent, or Firm* — Novak Druce Connolly Bove + Quigg LLP

(57) ABSTRACT

An electronic device can include a housing, a printed circuit board received in the housing, a key, and an adjusting member. The housing defines a through hole. The key is coupled to the housing and partially received in the through hole. The adjusting member is across the through hole. The adjusting member is movably coupled to the housing and contact the key.

16 Claims, 7 Drawing Sheets

ELECTRONIC DEVICE

FIELD

The subject matter herein generally relates to electronic devices, and particularly to an electronic device having at least one key.

BACKGROUND

An electronic device, such as a smart key of a car, usually has a key provided thereon. The electronic device includes a housing and a printed circuit board (PCB) received in the housing. The key can be depressed by application of force from outside of the housing.

BRIEF DESCRIPTION OF THE DRAWINGS

Implementations of the present technology will now be described, by way of example only, with reference to the attached figures.

DETAILED DESCRIPTION

Figure 1:
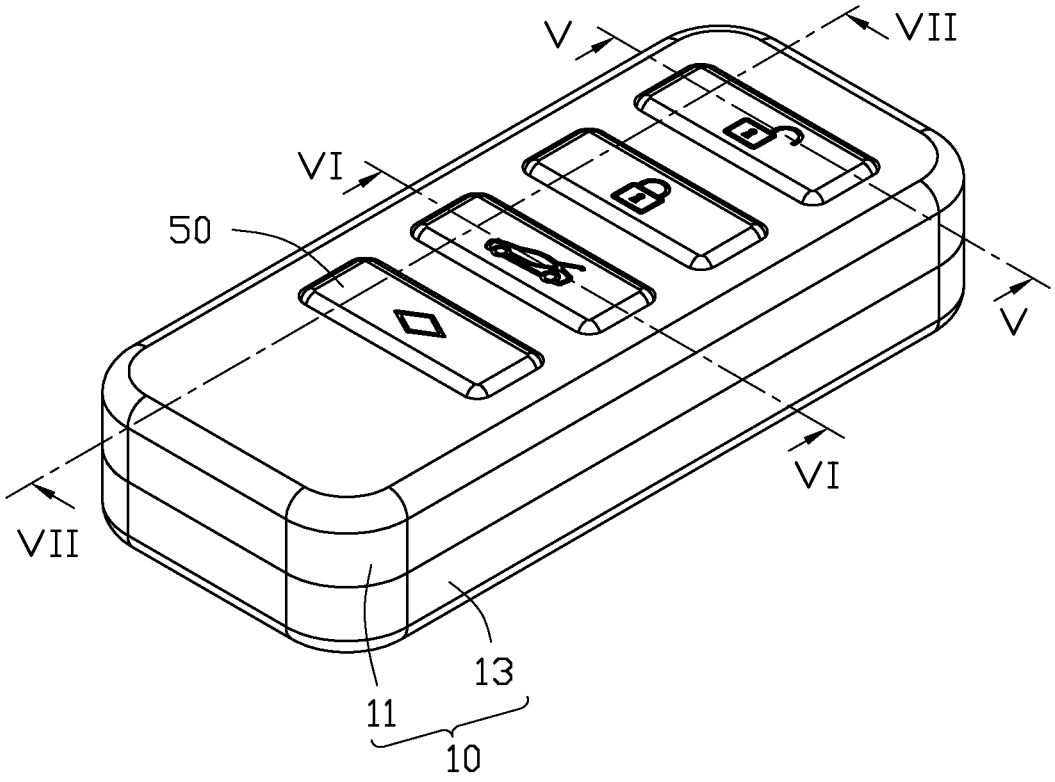
FIG. 1 is an isometric view of an embodiment of an electronic device.

It will be appreciated that for simplicity and clarity of illustration, where appropriate, reference numerals have been repeated among the different figures to indicate corresponding or analogous elements. In addition, numerous specific details are set forth in order to provide a thorough understanding of the embodiments described herein. However, it will be understood by those of ordinary skill in the art that the embodiments described herein can be practiced without these specific details. In other instances, methods, procedures, and components have not been described in detail so as not to obscure the related relevant feature being described. Also, the description is not to be considered as limiting the scope of the embodiments described herein. The drawings are not necessarily to scale and the proportions of certain parts may be exaggerated to better illustrate details and features of the present disclosure.

Several definitions that apply throughout this disclosure will now be presented.

The term "coupled" is defined as connected, whether directly or indirectly through intervening components, and is not necessarily limited to physical connections. The connection can be such that the objects are permanently connected or releasably connected. The term "substantially" is defined to be essentially conforming to the particular dimension, shape, or other feature that the term modifies, such that the component need not be exact. For example, "substantially cylindrical" means that the object resembles a cylinder, but can have one or more deviations from a true cylinder. The term "comprising," when utilized, means "including, but not necessarily limited to"; it specifically indicates open-ended inclusion or membership in the so-described combination, group, series and the like.

The present disclosure is in relation to an electronic device that can include a housing, a printed circuit board, a key, and an adjusting member. The housing can define a through hole. The printed circuit board can be received in the housing. The key can be coupled to the housing and partially received in the through hole. The adjusting member can be across the through hole. The adjusting member can be movably coupled to the housing and can contact the key.

The present disclosure is further in relation to an electronic device that can include a housing, a printed circuit board, a key, and an adjusting member. The housing can include a first cover and a second cover. The first cover can define a through hole. The extending portions can be coupled to the first cover and can be positioned at opposite sides of the through hole. The second cover can be detachably coupled to the first cover. The printed circuit board can be received in the housing. The key can be coupled to the first cover and partially received in the through hole. The key can be configured to depress by application of force from outside of the housing. The adjusting member can be movably coupled to the extending portions.

The present disclosure is further in relation to an electronic device that can include a housing, a printed circuit board received in the housing, a key, and two pairs of adjusting members received in the housing. The key can be coupled to the housing and configured to depress by application of force from outside of the housing. The pairs of adjusting members can be received in the housing. The adjusting members can be movably coupled to the housing. A distance between the adjusting members of one pair can be different from a distance between the adjusting members of another pair.

Figure 2:
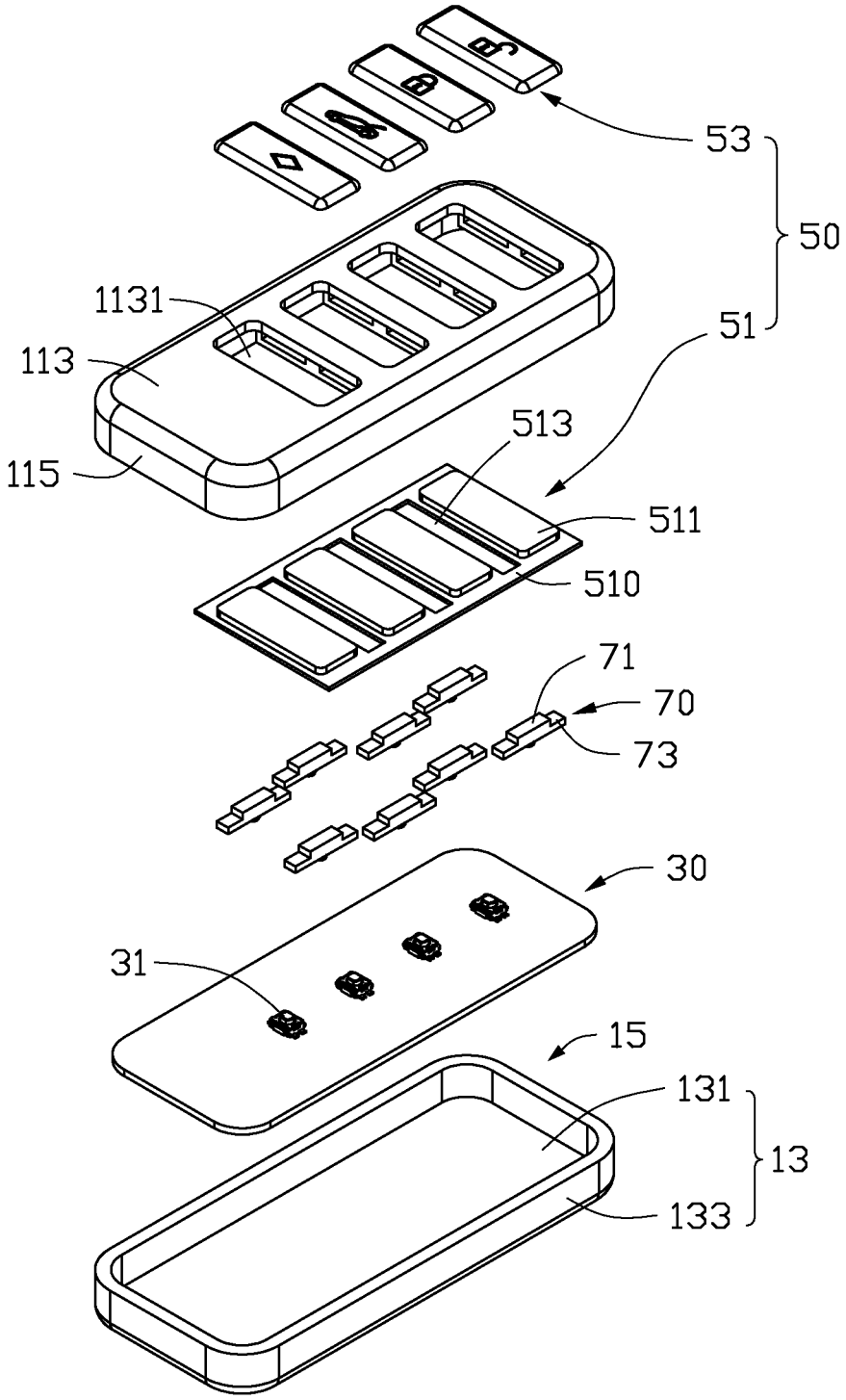
FIG. 2 is an exploded, isometric view of the electronic device of FIG. 1.

FIG. 1 illustrates an embodiment of an electronic device 100. The electronic device 100 can be substantially cuboid and include a housing 10 and a key 50 coupled to the housing 10. The housing 10 can include a first cover 11 and a second cover 13 detachably coupled to the first cover 11. FIG. 2 illustrates that the electronic device 100 can further include a printed circuit board 30 and a plurality of adjusting members 70 received in the housing 10. In the illustrated embodiment, the electronic device 100 is a smart key of a car.

The first cover 11 and the second cover 13 can define a receiving chamber 15, cooperatively. The printed circuit board 30 and the adjusting members 70 can be received in the receiving chamber 15. The key 50 can be partially received in the receiving chamber 15.

Both of the first cover 11 and the second cover 13 can be a housing having an opening. The first cover 11 can include a flat wall 113 and a sidewall 115 extending from edges of the flat wall 113. The sidewall 115 can be substantially perpendicular to the flat wall 113. The flat wall 113 can be substantially rectangular and define a plurality of through holes 1131 thereon. The through holes 1131 can be substantially rectangular and parallel to each other. In the illustrated embodiment, a number of the through holes 1131 can be four. The second cover 13 can be substantially similar to the first cover 11 in structure. The second cover 13 can include a flat wall 131 and a sidewall 133 extending from edges of the flat wall 131. The sidewall 133 can be substantially perpendicular to the flat wall 131. The second cover 13 and the first cover 11 can be fastened together or latched together.

Figure 3:
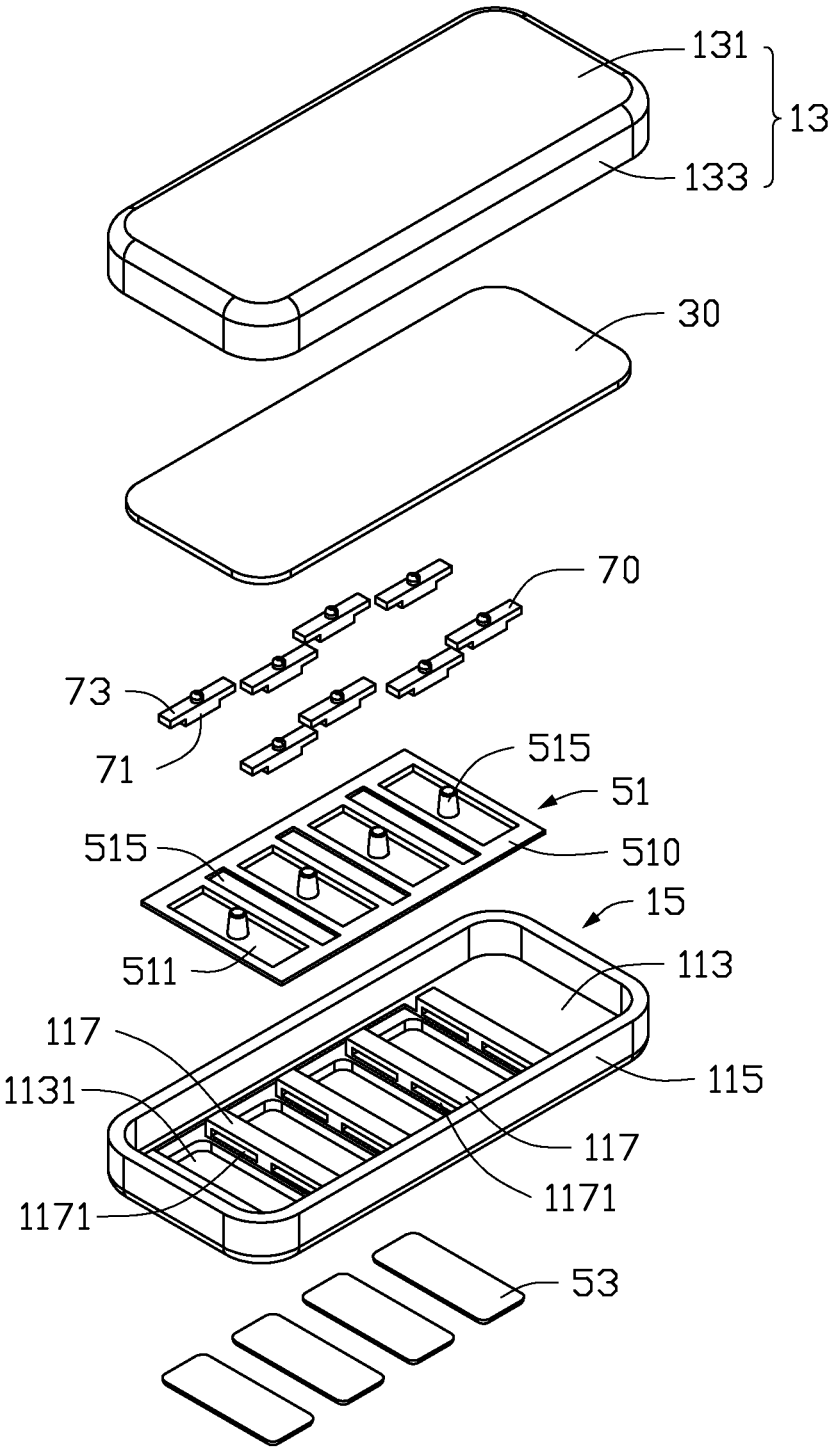
FIG. 3 is similar to FIG. 2, but viewed from another angle.
Figure 4:
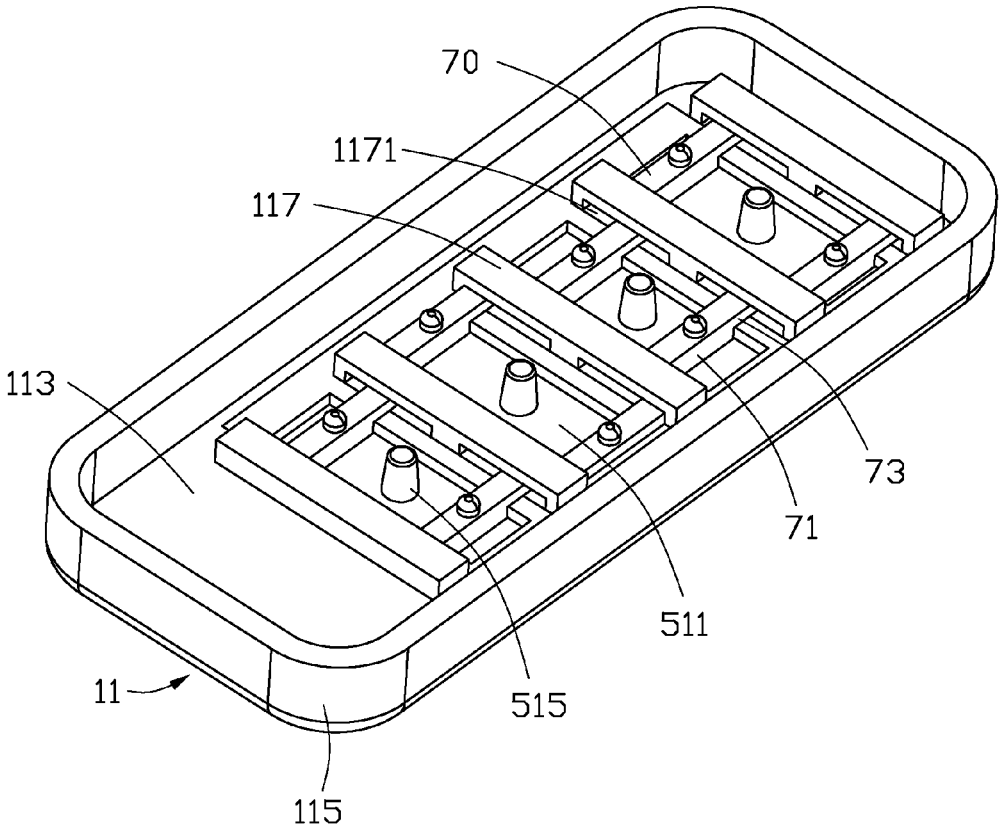
FIG. 4 is a partial, isometric view of the electronic device of FIG. 1.

FIGS. 3 and 4 illustrate that five extending portions 117 can be coupled to the flat wall 113 and positioned in the receiving chamber 15. The extending portions 117 can be substantially bar-shaped and substantially parallel to each other. Each through hole 1131 can be positioned between two adjacent extending portions 117. Each extending portion 117 can define at least one limiting groove 1171 parallel to the flat wall 113. In the illustrated embodiment, each extending portion 117 can define two limiting grooves 1171 spaced from each other. The limiting grooves 1171 of each extending portion 117 can be substantially symmetrical about a center axis of the first cover 11. The printed circuit board 30 can include four trigger portions 31 thereon. The trigger portions 31 can be arranged along a straight line.

The key 50 can be coupled to the first cover 11. The key 50 can include a key body 51 and four keycaps 53 coupled to the key body 51. The key body 51 can be substantially a rectangular board and coupled to the first cover 11. The key body 51 can include a limiting portion 510 and four protruding portions 511 protruding from the limiting portion 510. The protruding portions 511 can be substantially cuboids and received in the corresponding through holes 1131, respectively. The limiting portion 510 can be attached to an inner surface of the flat wall 113. The limiting portion 510 can define three latching grooves 513. Each latching groove 513 can be positioned between two adjacent protruding portions 511. The latching grooves 513 can be substantially bar-shaped corresponding to the three middle extending portions 117. The three extending portions 117 can pass through the latching grooves 513, respectively.

A contacting portion 515 can be formed on each extending portion 511. Each contacting portion 515 can be positioned between the extending portion 511 and the printed circuit board 30. Each contacting portion 515 can be substantially columnar and substantially positioned at a middle portion of the extending portion 511. Each contacting portion 515 can be aligned with one of the trigger portions 31.

Each keycap 53 can be substantially arcuate and suitable with the protruding portion 511. The keycaps 53 can be respectively coupled to the protruding portions 511 which received in the through holes 1131. Each keycap 53 can be partially received in the corresponding through hole 1131. When the keycap 53 is depressed by application of force from outside of the housing 10, the key cap 53 can move the protruding portion 511 and the contacting portion 515 towards the printed circuit board 30. Thus, the trigger portion 31 can be triggered.

The adjusting members 70 can be coupled to the extending portions 117 of the first cover 11 and across the through holes 1131. Each adjusting member 70 can be substantially T-shaped and include a main body 71 and two blocking portions 73 extending from opposite sides of the main body 71. The blocking portions 73 can be substantially symmetrical about a center axis of the adjusting member 70. In the illustrated embodiment, adjusting members 70 can be four pairs. FIG. 4 illustrates that each pair of the adjusting members 70 can be positioned between two adjacent extending portions 117 and can correspond to one of the through holes 1131. Each pair adjusting members 70 can be symmetrically positioned at opposite sides of the corresponding contact portion 515. A distance between the adjusting members 70 of each pair can be different from a distance between the adjusting members 70 of other pairs.

The main body 71 of each adjusting member 70 can be received in the protruding portion 511 and contact the protruding portion 511. Each blocking portion 73 can be movably received in the corresponding limiting groove 1171. Each adjusting member 70 can move in the limiting groove 1171 along a lateral direction of the first cover 11.

When the keycap 53 is depressed by application of force from outside of the housing 10, the force is also applied to the adjusting members 70. Thus, the blocking portions 73 can abut against the extending portions 117 and act as a support point. A position of each adjusting member 70 can be changed by moving the adjusting member 70 in the limiting groove 1171. A needed force for depressing the keycap 53 can be different corresponding to different position of the adjusting members 70.

Figure 5:
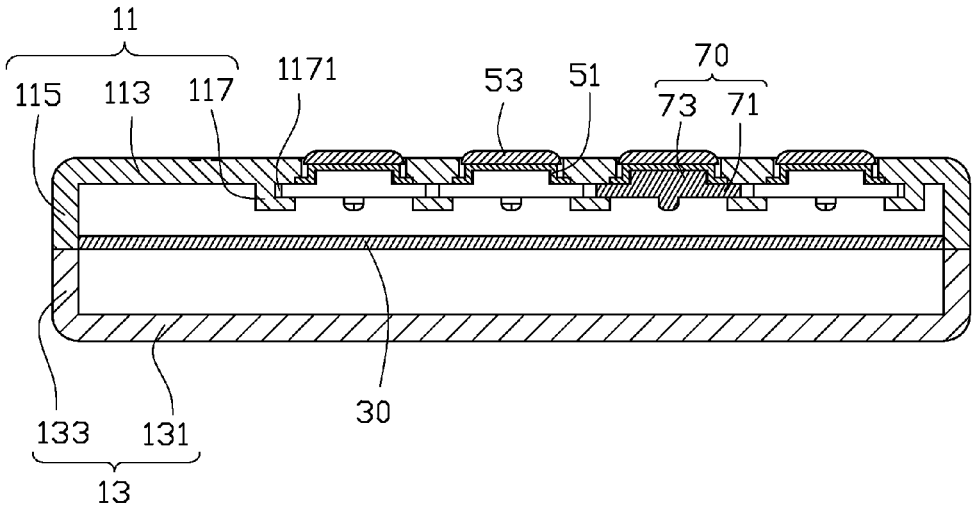
FIG. 5 is a cross-sectional view taken along a line V-V of the electronic device of FIG. 1.
Figure 6:
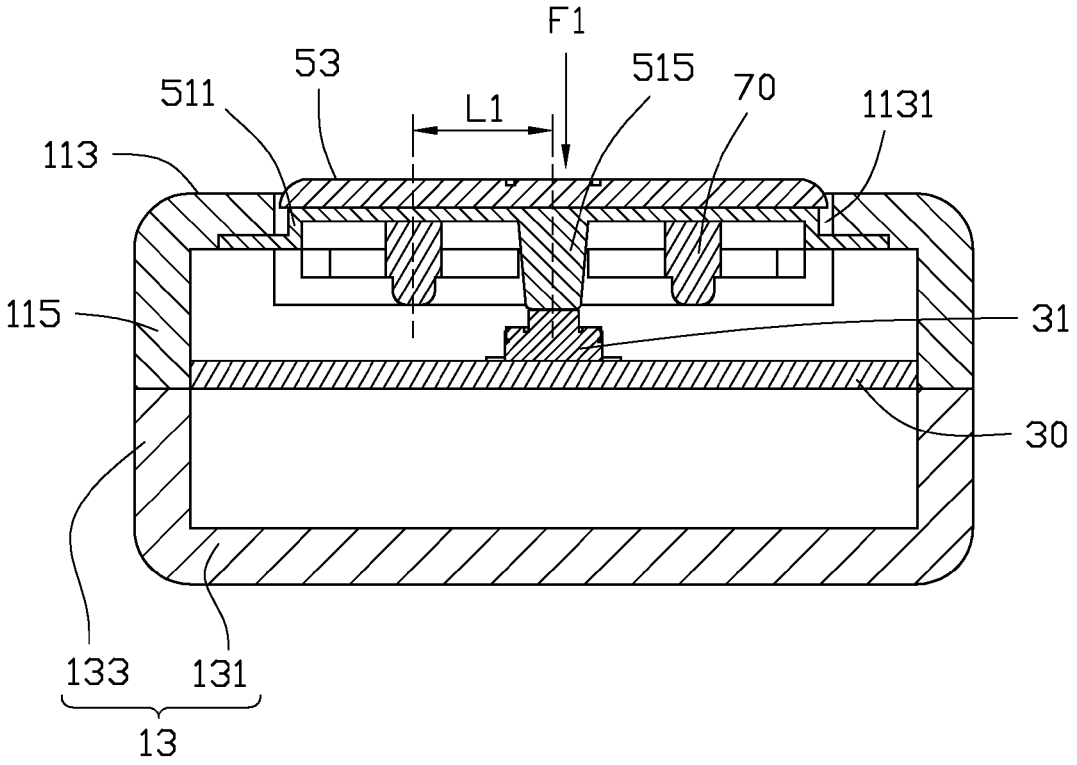
FIG. 6 is a cross-sectional view taken along a line VI-VI of the electronic device of FIG. 1.

When in assembly, referring to FIGS. 5 and 6, the keycaps 53 of the key 50 can be coupled to the first cover 11 and received in the through holes 1131. The key body 51 of the key 50 can be coupled to the first cover 11. The extending portions 117 can pass through the latching grooves 513 and the protruding portions 511 can pass through the through holes 1131. The adjusting members 70 can be coupled to the first cover 11 and the main body 71 of each adjusting member 70 can face the extending portion 117. The blocking portions 73 of each adjusting member 70 can be received in the limiting grooves 1171. The limiting portion 510 can be positioned between the flat wall 113 of the first cover 11 and the adjusting members 70. The printed circuit board 30 can be received in the first cover 11. The second cover 13 can be coupled to the first cover 11.

Figure 7:
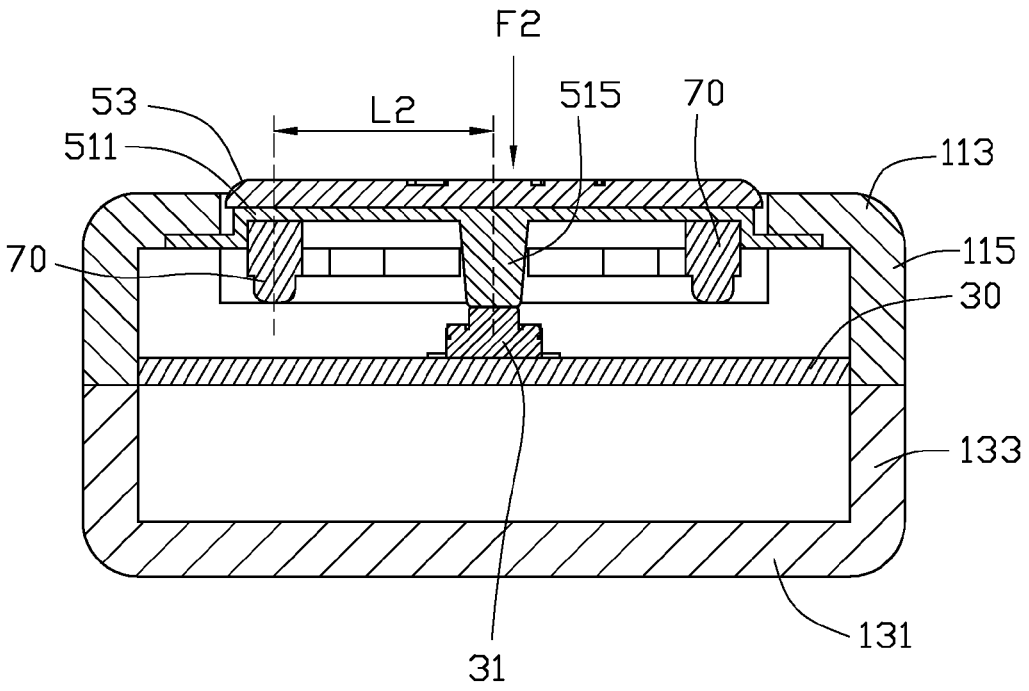
FIG. 7 is a cross-sectional view taken along a line VII-VII of the electronic device of FIG. 1.

Referring to FIG. 6, a distance between the adjusting member 70 and the contacting portion 515 can be defined as L1. A needed force for depressing the key 50 can be defined as F1. When a force F1 is applied to the key 50, a moment of the key 50 can be defined as M1. The following mathematical function relationships can thus be defined: M1=F1*L1. Referring to FIG. 7, the adjusting members 70 are moved. A distance between the adjusting member 70 and the contacting portion 515 can be defined as L2. A needed force for depressing the key 50 can be defined as F2. When a force F2 is applied to the key 50, a moment of the key 50 can be defined as M2. The following mathematical function relationships can thus be defined: M2=F2*L2. Because the distance L1 is different from the distance L2, the force F1 is different from the force F2.

In at least one embodiment, the keycap 53 can be omitted and the protruding portions 511 can be act as keycaps. A number of the protruding portions 511 or the through holes 1131 can be one or more than one. The electronic device 100 can be not limited to be a smart key and can be telephone, for example.

The embodiments shown and described above are only examples. Many details are often found in the art such as the other features of an electronic device. Therefore, many such details are neither shown nor described. Even though numerous characteristics and advantages of the present technology have been set forth in the foregoing description, together with details of the structure and function of the present disclosure, the disclosure is illustrative only, and changes may be made in the details, including in matters of shape, size, and arrangement of the parts within the principles of the present disclosure, up to and including the full extent established by the broad general meaning of the terms used in the claims. It will therefore be appreciated that the embodiments described above may be modified within the scope of the claims.

What is claimed is:

1. An electronic device comprising:

a housing defining a through hole;

a printed circuit board received in the housing;

a key coupled to the housing and partially received in the through hole;

an adjusting member across the through hole, the adjusting member being movably coupled to the housing and contacting the key;

wherein two extending portions are coupled to the housing and positioned at opposite sides of the through hole, the adjusting member is movably coupled to the extending portions; and wherein the adjusting member comprises a main body and two blocking portions extending from opposite sides of the main body, the main body is received in the housing, each extending portion defines a limiting groove, the two blocking portions are received in the limiting grooves, respectively, the two blocking portions are configured to move in the limiting grooves.

2. The electronic device of claim 1, wherein the housing comprises a first cover and a second cover detachably coupled to the first cover, the first cover and the second cover define a receiving chamber, cooperatively, the printed circuit board and the adjusting member are received in the receiving chamber, the through hole is defined at the first cover, the extending portions are coupled to the first cover.

3. The electronic device of claim 2, wherein the first cover comprises a flat wall and a sidewall extending from edges of the flat wall, the through hole is defined at the flat wall.

4. The electronic device of claim 1, wherein the key defines at least one latching groove, and wherein one of the two extending portions passes through the at least one latching groove.

5. The electronic device of claim 4, wherein the key comprises a key body coupled to the housing, the key body comprises a limiting portion and a protruding portion protruding from the limiting portion, the protruding portion is partially received in the through hole, the main body is partially received in the protruding portion and contact the protruding portion, the limiting portion is positioned between the housing and the adjusting members, the at least one latching groove is defined at the limiting portion.

6. The electronic device of claim 5, wherein the key further comprises a keycap coupled to the key body.

7. The electronic device of claim 5, wherein the printed circuit board comprises a trigger portion, a contacting portion is formed on the extending portion that is aligned to the trigger portion.

8. The electronic device of claim 1, wherein the electronic device is a smart key of a car.

9. An electronic device comprising:

a housing comprising:

a first cover defining a through hole, two extending portions coupled to the first cover and positioned at opposite sides of the through hole, and a second cover detachably coupled to the first cover;

a printed circuit board received in the housing;

a key coupled to the first cover and partially received in the through hole, the key configured to depress by application of force from outside of the housing;

an adjusting member being movably coupled to the extending portions; and wherein the adjusting member comprises a main body and two blocking portions extending from opposite sides of the main body, the main body is received in the housing, each extending portion defines a limiting groove, the two blocking portions are receiving in the limiting grooved of the extending portions, respectively, the two blocking portions are configured to move in the limiting grooves.

10. The electronic device of claim 9, wherein the key comprises a key body coupled to the first cover and a keycap coupled to the key body, the key body comprises a limiting portion and a protruding portion protruding from the limiting portion, the protruding portion is partially received in the through hole, the main body is partially received in the protruding portion and contacts the protruding portion, the limiting portion is positioned between the first cover and the adjusting member.

11. The electronic device of claim 10, wherein the limiting portion defines two latching grooves, the extending portions pass through the latching grooves, respectively.

12. The electronic device of claim 11, wherein the printed circuit board comprises a trigger portion, a contacting portion is formed on the extending portion that is aligned to the trigger portion.

13. The electronic device of claim 9, wherein the electronic device is a smart key of a car.

14. An electronic device comprising:

a housing;

a printed circuit board received in the housing;

a key coupled to the housing and configured to depress by application of force from outside of the housing;

two pairs of adjusting members are received in the housing, the adjusting members being movably coupled to the housing, a distance between the adjusting members of one pair is different from a distance between the adjusting members of another pair; and wherein three extending portions are coupled to the housing and parallel to each other, each extending portions defines two limiting grooves, each pair of adjusting members is positioned between two adjacent extending portions, each adjusting member comprises a main body and two blocking portions extending from opposite sides of the main body, the two blocking portions of each adjusting member are respectively received in the limiting grooves of the two adjacent extending portions.

15. The electronic device of claim 14, wherein the key comprises a key body and two keycaps coupled to the key body, the housing defining two through holes, the key body comprises a limiting portion and two protruding portions protruding from the limiting portion, the protruding portions are partially received in the through holes, respectively, the limiting portion is positioned between the housing and the adjusting members.

16. The electronic device of claim 15, wherein a contacting portion is formed on each protruding portion, each pair adjusting members are symmetrically positioned at opposite sides of the corresponding contact portion.

* * * * *